United States Patent [19]

Carver

[11] Patent Number: 4,563,971

[45] **Date of Patent: * Jan. 14, 1986**

[54] RETRACTABLE BOAT KEEL

[76] Inventor: George P. Carver, 26 Linda Isle, Newport Beach, Calif. 92660

[ * ] Notice: The portion of the term of this patent subsequent to Mar. 15, 2000 has been disclaimed.

[21] Appl. No.: 664,574

[22] Filed: Oct. 25, 1984

Related U.S. Application Data

[63] Continuation-in-part of Ser. No. 436,317, Jan. 27, 1983, abandoned.

[51] Int. Cl.[4] ..... B63B 41/00

[52] U.S. Cl. ..... 114/132; 114/141

[58] Field of Search ..... 114/127–143, 114/162, 163, 348, 349, 285

[56] References Cited

U.S. PATENT DOCUMENTS

| | | | |
|---|---|---|---|
| 327,724 | 10/1885 | Schermerhorn | 114/132 |
| 329,088 | 10/1885 | Schermerhorn | 114/132 |
| 650,758 | 5/1900 | Lake | 114/132 |
| 3,938,458 | 2/1976 | Irgens | 114/285 |
| 3,951,090 | 4/1976 | Potter | 114/132 |
| 4,067,280 | 1/1978 | Serfess | 114/128 |
| 4,376,416 | 3/1983 | Carver | 114/140 |

FOREIGN PATENT DOCUMENTS 878936 10/1961 United Kingdom .

*Primary Examiner*—Trygve M. Blix
*Assistant Examiner*—Thomas J. Brahan
*Attorney, Agent, or Firm*—Frank Charles Price

[57] ABSTRACT

A boat hull keel is disclosed which retracts into the boat hull on a fixed pivot. The pivot location is placed above the keel/hull bottom intersection, rearward of the major axis of the fully lowered keel and rearward of the keel trailing edge at the keel/hull intersection. The placement distances are large in terms of the maximum keel chord length. (measured at the keel/hull intersection.) This amounts to a novel location. The location of the pivot allows the keel rotation to create a change in the attitude of the boat hull.

1 Claim, 3 Drawing Figures

RETRACTABLE BOAT KEEL

Continuation-in-part Application of the Parent Ser. No. 06/436,317, 1 filed Jan. 27, 1983, now abandoned.

References cited in the filing of the Patent:

| | | |
|---|---|---|
| 650,758 | Lake | May 29, 1900 |
| 4,067,280 | Serfess | Jan. 10, 1978 |
| 329,088 | Schermerhorn | Oct. 27, 1885 |
| 3,938,458 | Irgens | Feb. 17, 1976 |
| 327,724 | Schermerhorn | Oct. 6, 1885 |
| 3,951,090 | Potter | April 20, 1976 |
| 4,376,416 | Carver | Mar. 15, 1983 |
| 878,936 G.B. | Readman | Oct. 4, 1961 |

BACKGROUND

1. Field of the invention

The present invention relates to a boat keel which can be retracted completely from the water by a hinged action. The keel has high aspect ratio and causes a large shift in position of boat center-of-gravity upon retraction.

2. Description of the Prior Art

Retractable keels normally retract straight upward. These are usually called centerboards. Serfess offers a hinged keel which does not retract completely out of the water. The Serfess keel hinges with the hinge point essentially directly over the position of the fully dropped keel. The result of retracting is a rearward movement of the keel center-of-gravity which is something less than half the length of the keel projection below the hull.

Potter's keel operating system is used to allow various positions to optimize sailing performance and to allow keel "pop-up" if the keel strikes something.

Potter uses a vertically positioned cylinder and his keel is pivoted so that it falls down to complete its downward movement. Reedman mentions a plywood centerboard, something of near-neutral buoyancy which in movement to various positions would have little effect on the location of the boat center of gravity. The Readman centerboard pivot is forward of the keel trailing edge. The centerboard movement is sealed on the top of its casing in the hull. Lake's invention does not involve a keel nor does it involve a change in the fore-aft weight distribution of the boat.

Schermerhorn has a hinged centerboard which is designed to maintain a constant boat center of gravity location as the centerboard is raised or lowered. His pivot is forward of the trailing edge and at of the center-of-gravity of the centerboard only about three-eighths of a chord length.

SUMMARY OF THE PRESENT INVENTION

In the present invention a hinged keel is provided which creates a large rearward shift or center-of-gravity of the keel when it is retracted into the boat hull. This is accomplished by two concepts: one is the location of the keel hinge point substantially to the rear and above the keel/hull intersection location when the keel is in its downward position; the other is a high keel aspect ratio which creates a large radius of swing for the center-of-gravity of the keel as it is rotated of its hinge.

DESCRIPTION OF THE PREFERRED EMBODIMENT

Figure 1:
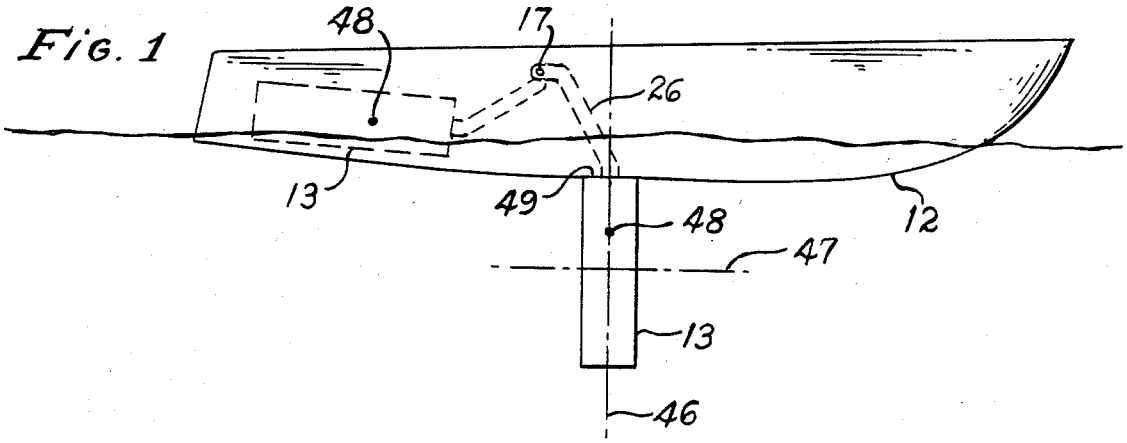
FIG. 1 shows a profile view of the boat hull depicting the keel in solid lines in its downward position and depicting the keel in its retracted position in dashed lines.

Referring to FIG. 1, there is illustrated a boat hull with extended keel 13. The keel 13 has a major axis 46 shown in its position with a fully lowered keel. The keel 13 has an upper extention arm 26 leading to the fixed pivot 17. The center-of-gravity 48 of the total keel structure including the extension arm 26 and the wettable keel 13 is shown above the vertical midline 47 of the wettable keel 13, as influenced by the location and weight of the extension arm 26. The top 49 of the wettable keel 13 is, of course, even with the hull bottom 12 when the keel is down. The extent of pivoting is great enough to allow the keel 13 to be completely retracted into the hull 12. In order for the keel 13 to be readily contained completely within the hull 12, the keel 13 is narrow, has a relatively small cord for the size of the hull 12. With a narrow keel width, in order for the keel 13 to have greater weight and to have greater surface for hydrodynamic effect, it has an aspect ratio, chord/2x length, of 3 or greater. The retracted keel 13 is shown in dotted lines.

Figure 2:
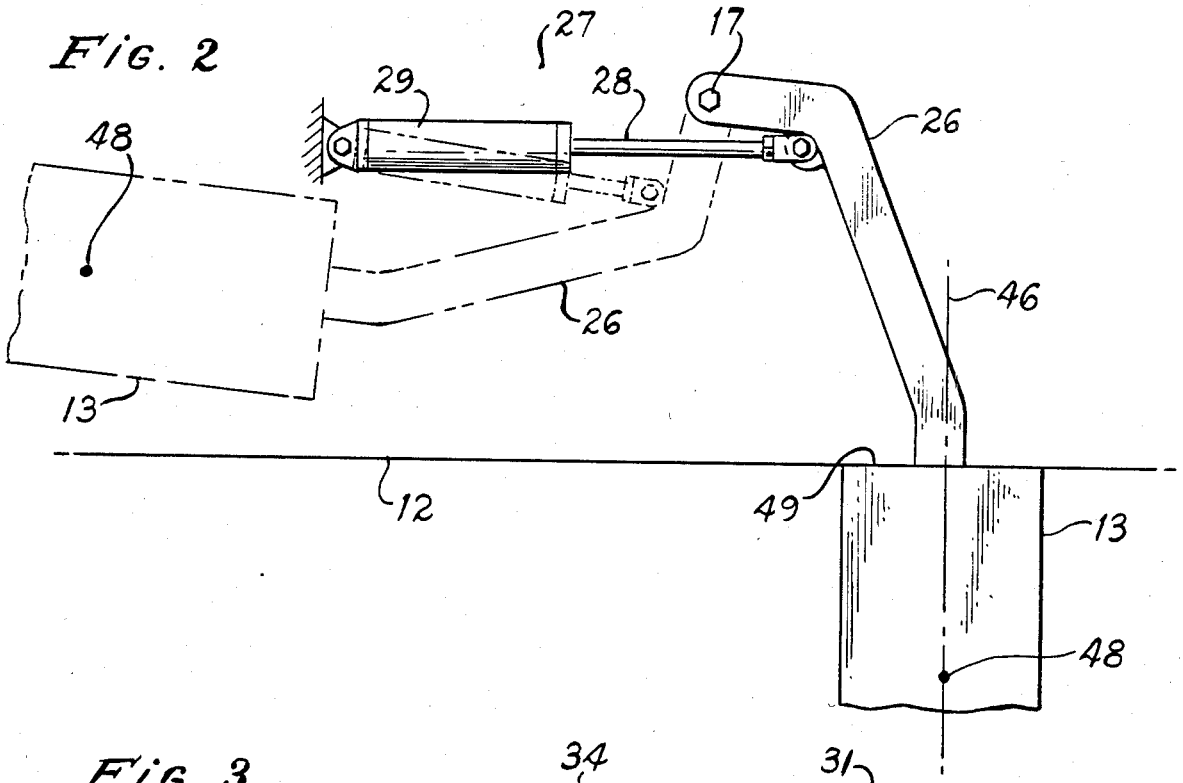
FIG. 2 shows the keel retraction mechanism.

FIG. 2 illustrates the keel retraction mechanism 27. A hydraulic cylinder 29, or other mechanical thrust device, with its piston arm 28 pulls the keel extension arm 26 causing the entire keel 13 and arm 26 to rotate about the pivot 17. The distances of the pivot 17 location above the hull bottom 12 and to the rear of the center of the fully-deployed keel 13 both contribute, upon retraction, to a large rearward movement of the keel 13 center-of-gravity. This property of large center-of-gravity movement makes the use of keel 13 applicable where conversion of a displacement hull to a planning with a retracted keel is desired.

The distances of the pivot 17 above the hull bottom 12 and to the rear of the center of the fully deployed keel 13 can be measured in terms of the length of the maximum keel cord. Thus, the pivot 17 is located by two distances, longitudinal and vertical, the unit of measure being the maximum chord length of the keel, MCL. The longitudinal distance is ½ MCL, or greater, aft of the intersection of the trailing edge of the downwardly positioned keel 13 with the bottom of the hull 12, and, the longitudinal distance is also more than one MCL aft of the location of the center-of-gravity of the keel 13 in its fully-extended position. The vertical distance locates the pivot 17 more than one MCL above the bottom surface of the hull 12.

Figure 3:
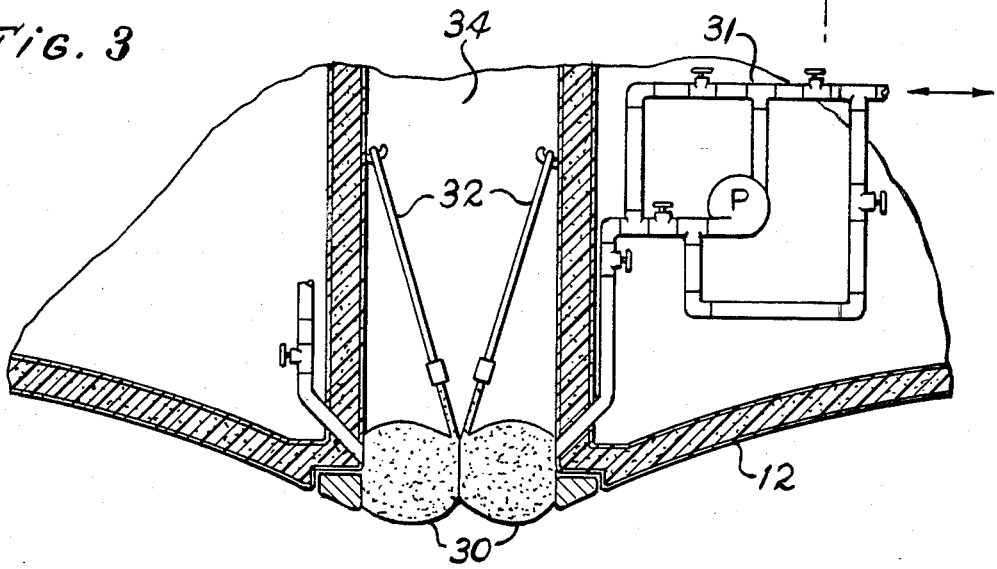
FIG. 3 is a cross section of the hull in the vicinity of the well for the retracted keel showing the well sealed against water intrusion.

FIG. 3 shows the configuration and parts of the well 34 in which the retracted keel of FIG. 1 resides, sealed out of the water where it can offer no resistance to movement of the hull 12. The well is sealed by two impinging bladders 30 which are inflated by a hydraulic or air supply system 31. The system pumps fluid in or out of the bladders to seal or to open the well 34 respectively. The stretchable cords 32 are attached to the bladder and serve to pull the bladders aside whenever the well 34 is to be open for keel entrancing or exiting.

I claim:

1. A retractable boat hull keel, the keel operating at two positions, fully retracted or fully extended, the keel retracting by rotation about a fixed pivot, the rotation being stroked by a positive actuator, the pivot being located aft of the trailing edge of the keel, located aft of the major axis of the downwardly located keel, and located above the bottom line of the hull, the improvement comprising:

the keel pivot being located by a combination of two distances relative to the keel geometry, the keel center-of-gravity, and the bottom of the hull, the first distance being more than ½ the maximum keel chord length aft of the trailing edge of the keel at the keel-hull intersection in the keel position of complete extension, and being more than one maximum keel chord length aft of the keel center-of-gravity in the fully extended keel position, the second distance being more than one maximum keel chord length above the bottom surface of the boat hull, the effect of the keel pivot location being a rearward movement of the boat center-of-gravity upon the retraction of the keel, the alternate rearward and forward changes in the position of the boat center-of-gravity allowing two performances modes for the boat hull, in conjunction with the two keel positions, the performance modes being powered and sail propulsion.

* * * * *